US009151497B2

(12) United States Patent
Happe et al.

(10) Patent No.: US 9,151,497 B2
(45) Date of Patent: Oct. 6, 2015

(54) GAS REGULATOR FITTING

(71) Applicant: Mertik Maxitrol GmbH & Co. KG, Thale (DE)

(72) Inventors: Barbara Happe, Gernrode (DE); Frank Pusch, Thale (DE)

(73) Assignee: MERTIK MAXITROL GMBH & CO. KG, Thale (DE)

( * ) Notice: Subject to any disclaimer, the term of this patent is extended or adjusted under 35 U.S.C. 154(b) by 0 days.

(21) Appl. No.: 14/102,094

(22) Filed: Dec. 10, 2013

(65) Prior Publication Data

US 2014/0137954 A1 May 22, 2014

Related U.S. Application Data

(63) Continuation of application No. 13/254,931, filed as application No. PCT/EP2010/001246 on Mar. 1, 2010, now Pat. No. 8,602,047.

(30) Foreign Application Priority Data

Mar. 4, 2009 (DE) ..... 10 2009 011 611

(51) Int. Cl.
*F23N 1/00* (2006.01)
*F24C 3/12* (2006.01)

(52) U.S. Cl.
CPC . *F23N 1/007* (2013.01); *F24C 3/12* (2013.01); *F23N 2025/14* (2013.01); *Y10T 137/1407* (2015.04); *Y10T 137/7737* (2015.04)

(58) Field of Classification Search
CPC ..... F23N 1/007; F23N 2025/14; F24C 3/12; Y10T 137/1407; Y10T 137/7737
USPC ..... 137/65, 468
See application file for complete search history.

(56) References Cited

U.S. PATENT DOCUMENTS 2,123,283 A * 7/1938 Kronmiller ..... 236/42
2,245,060 A 6/1941 Waddell (Continued)

FOREIGN PATENT DOCUMENTS

DE 2049355 A1 10/1971
DE 29905204 U1 6/1999

(Continued)

OTHER PUBLICATIONS

English language translation of DE 2049355 extracted from espacenet database on Mar. 19, 2014, 16 pages.

(Continued)

*Primary Examiner* — Kevin Lee
(74) *Attorney, Agent, or Firm* — Howard & Howard Attorneys PLLC

(57) ABSTRACT

A gas regulator fitting is to be devised that prevents distortions of the temperature value to be regulated caused by ambient temperature fluctuations. Retrofitting without intervention into the gas-conducting space is also to be made possible. To that end, one or more bimetal discs (17) are arranged outside the gas-conducting space of the gas regulator fitting, between an operating element (18) for setting the required temperature and a longitudinally movable ram (8) whose position can be altered by means of metal bellows (9) which are connected to a temperature sensor (11) by a capillary line (10). The ram (8) protruding into the gas-conducting space activates a switch which controls a valve for regulating the gas stream to the main burner. The bimetal discs (17) are arranged in such a manner that their overall height, which is altered in the direction of movement of the ram (8) depending on the ambient temperature, can influence the position of the metal bellows (9).

4 Claims, 3 Drawing Sheets

(56) References Cited

U.S. PATENT DOCUMENTS

Figure 1:
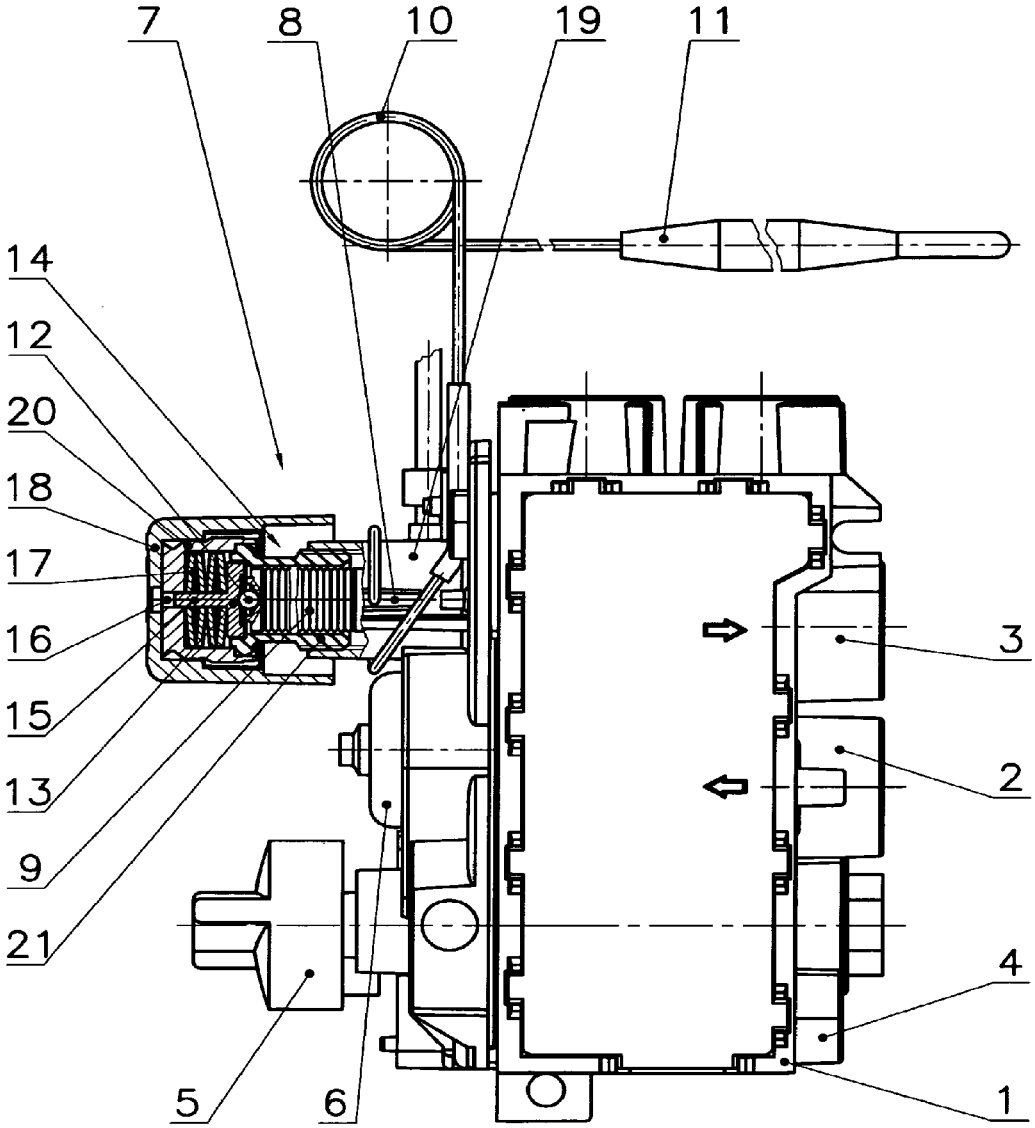

| | | | | |
|---|---|---|---|---|
| 2,245,171 | A | 6/1941 | Wetzel | |
| 2,801,800 | A | 8/1957 | Brumbaugh | |
| 2,980,386 | A | 4/1961 | Reinhart et al. | |
| 4,836,496 | A | 6/1989 | Abujudom et al. | |
| 8,602,047 | B2 * | 12/2013 | Happe et al. | 137/65 |

FOREIGN PATENT DOCUMENTS

| | | | |
|---|---|---|---|
| FR | 2379035 | A1 | 8/1978 |
| GB | 1592008 | A | 7/1981 |
| WO | 0057107 | A1 | 9/2000 |

OTHER PUBLICATIONS

English language translation of WO 0057107 extracted from espacenet database on Mar. 19, 2014, 33 pages.

PCT International Search Report for PCT/EP2010/001246, dated Oct. 8, 2010, 3 pages.

* cited by examiner

GAS REGULATOR FITTING

The subject patent application is a continuation of U.S. patent application Ser. No. 13/254,931 filed Oct. 17, 2011, now U.S. Pat. No. 8,602,047, which claims priority to and all the benefits of International Patent Application No. PCT/EP2010/001246 filed Mar. 1, 2010, which claims priority to and all of the benefits of German Patent Application No. 10 2009 011 611.7 filed on Mar. 4, 2009, the contents of all of which are expressly incorporated herein by reference.

TECHNICAL FIELD OF THE INVENTION

The invention relates to a gas regulator fitting for a gas heater or the like according to the preamble to the first claim.

STATE OF THE ART

Gas regulator fittings for a gas heater or the like exist in a multitude of embodiments. They serve to ignite and control or regulate a gas stream flowing to a burner in order to ensure safety for the operator and the heater. Normally, the ambient temperature serves here as a controlled variable. The ambient temperature is measured by a temperature sensor connected by a capillary line to metal bellows serving as a lifting element.

There are also gas regulator fittings in which the main stream is switched on or off (on-off controller) or else the gas regulator fitting has a combined on-off controller and proportional controller.

A gas regulator fitting is therefore known from DE 299 05 204 U1 which is preferably for installation in single room heaters and which operates without auxiliary energy. The switching system of a combined proportional and on-off controller is arranged in the housing of this gas regulator fitting downstream of the main valve. This switching system can be influenced by a temperature-sensitive regulating unit which comprises a temperature sensor located outside the housing and metal bellows arranged in the gas regulator fitting, both of which are interconnected by a capillary line, with all components filled with fluid. Such regulating units work on the principle of the expansion of fluids that occurs on an increase of temperature. A change in the temperature at the temperature sensor causes a correspondingly directed movement of the bellows. This travel is transferred to the switching system.

Accordingly, gas regulator fittings must normally be adjusted during manufacture. This adjustment entails exposing the capillary line and metal bellows to the temperature prevailing in their surroundings. The disadvantage of this procedure is that the control temperature, which is based on the set, i.e. required target value, is distorted as soon as other ambient temperatures prevail when the device is used at its subsequent place of installation. This is particularly serious and no longer acceptable if deviations from the ambient temperature are not relatively constant but fluctuate widely. However, this is nearly always the case if the gas regulator fitting is located in the gas heater, i.e. in the vicinity of the gas burner, in order to produce a gas heater of compact dimensions.

SUMMARY OF THE INVENTION

The invention addresses the problem of creating a gas regulator fitting that prevents distortions of the temperature value to be regulated caused by ambient temperature fluctuations. Furthermore, the gas regulator fitting is to be of as simple a structure as possible. Retrofitting is also to be made possible without intervention into the gas-conducting space.

The problem is solved according to the invention in that one or more bimetal discs are arranged outside the gas-conducting space of the gas regulator fitting between an operating element for setting the required temperature and a longitudinally movable ram. A switch controlling at least one valve for regulating the gas stream to the main burner is activated by the ram which protrudes into the gas-conducting space. The bimetal discs are arranged in such a manner here that their overall height, which alters in the direction of movement of the ram depending on the ambient temperature, can influence the position of the metal bellows.

This arrangement has provided a means of eliminating the effect of the ambient temperature. The additional expansion of the metal bellows in the form of an additional travel occurring at a high ambient temperature is compensated by the bimetal discs. Moreover, the solution has a simple structure and mode of action.

It is particularly advantageous if the bimetal discs arranged between the metal bellows and the operating element are positioned as close as possible to the metal bellows. In this way both components are exposed to the same temperature effect and compensation is carried out very accurately.

A further advantageous embodiment is created if a connecting piece is supported on the metal bellows, especially if the connecting piece also has on its front side facing away from the metal bellows an axial peg to receive the bimetal discs which are then centrally perforated, and if the peg is guided in a guide bore of a pressure piece which is permanently connected to the operating element and on which the bimetal discs are supported.

In this embodiment the bimetal discs together with the connecting piece and, advantageously, the pressure piece as well form a component assembly that can be preassembled and installed very easily during manufacture or retrofitting.

In order to enable temperature adjustments to be altered at a later time as well, it is advantageous if an adjusting element is used in the pressure piece whose position is adjustable axially from outside and on which the bimetal discs are supported.

EXECUTION EXAMPLE

Figure 2:
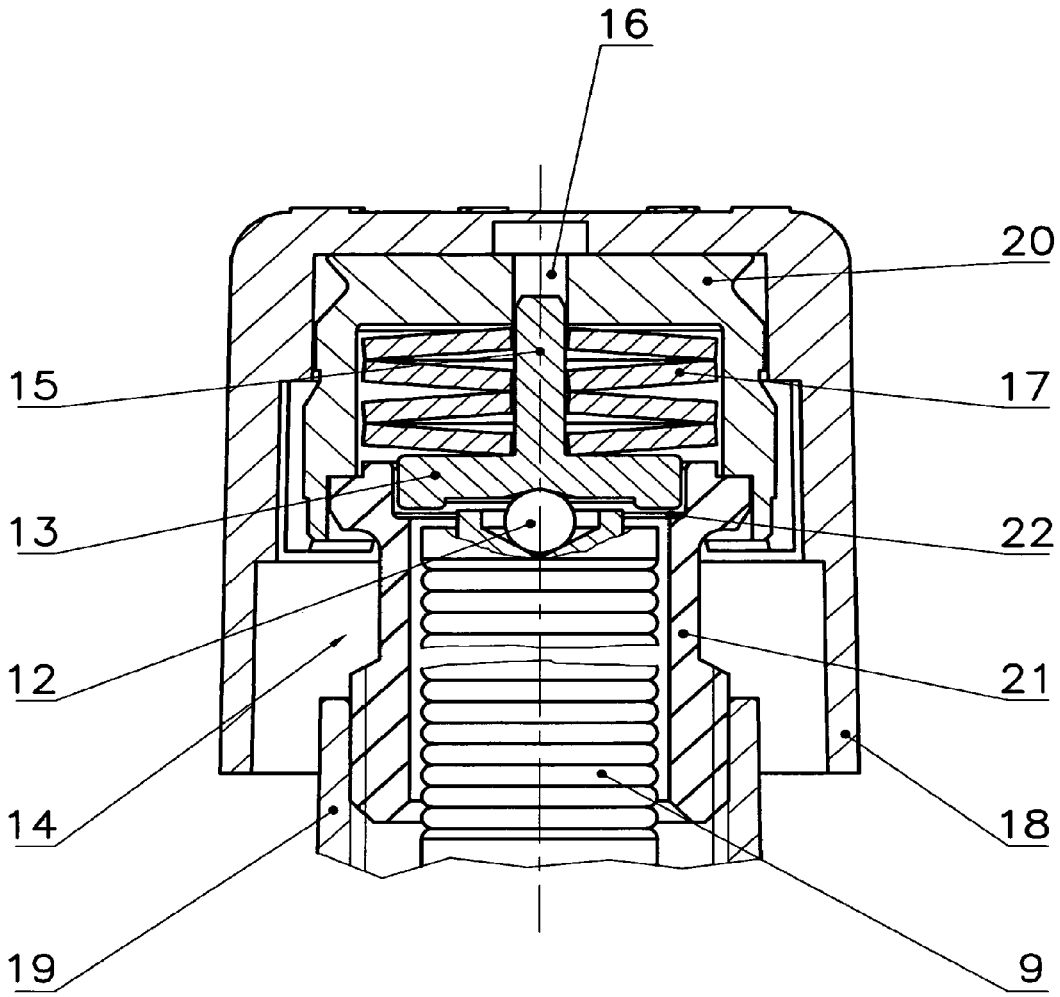
Figure 3:
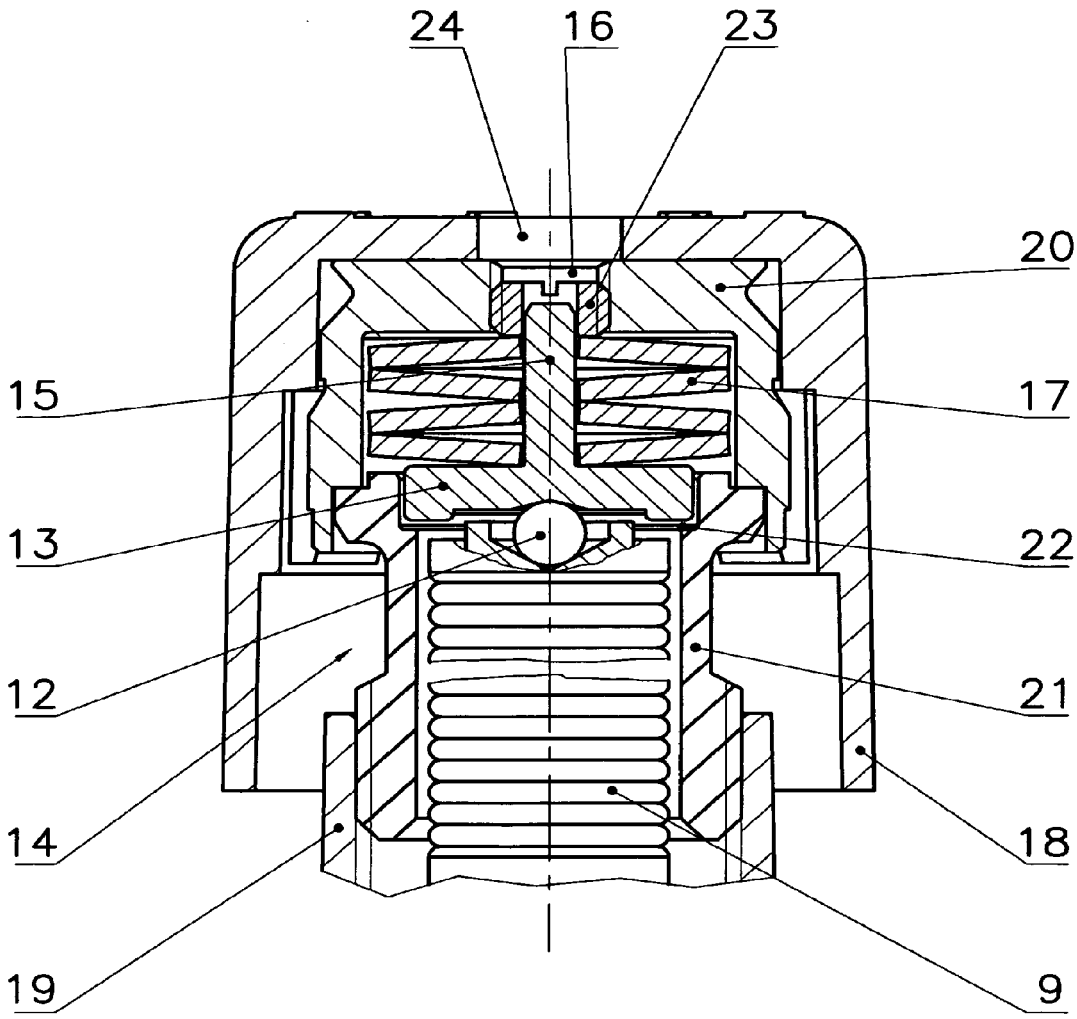

The invention is described in more detail below by means of an execution example. The illustrations show the following:

FIG. 1 partly sectional view of a gas regulator fitting according to the invention FIG. 2 a detailed view A of the gas regulator fitting from FIG. 1 according to the invention FIG. 3 a modified detailed view A of the gas regulator fitting from FIG. 1 according to the invention The exemplary gas regulator fitting according to the invention depicted in FIG. 1 is a switching and controlling device intended primarily for installation in a gas heater or the like. It enables a burner to be operated and monitored by controlling the amount of gas flowing to the burner.

The gas regulator fitting comprises a housing 1 with a gas inlet 2 identified by a directional arrow and a gas outlet 3 also identified by a directional arrow, as well as an ignition gas outlet 4. The following functional elements looked at in the direction of flow of the gas are accommodated in the housing 1:

Start-up with the associated operating element 5,

Safety pilot valve and main valve with safety interlock device,

Pressure regulator 6,

Temperature control valve 7 for the amount of gas flowing to the main burner.

A detailed description and explanation of the start-up, safety pilot valve and main valve as well as the pressure regulator 6 have not been given in this execution example because the structure and mode of action of these components are known to those skilled in the art.

A valve that effects a stepwise switching on and off in the partial load area is arranged in the housing 1 downstream of the main valve in the flow path of the gas stream for the main burner downstream of the pressure regulator 6. The valve is controlled by a switch.

A longitudinally movable ram 8 connected non-positively to the switch protrudes from the gas-conducting space of the housing 1. The ram 8 is supported on its end facing away from the switch on metal bellows 9. The metal bellows 9 are connected by a capillary line 10 to a temperature sensor 11. Metal bellows 9, capillary line 10 and temperature sensor 11 are filled with a thermoactive fluid.

In order to make a temperature adjustment during manufacture, a connecting piece 13 is supported on the metal bellows 9 on its side facing away from the ram 8, in this execution example advantageously on an intermediately mounted ball 12. The connecting piece 13 is guided in a guide bore 16 of a pressure piece 14 by an axial peg 15 located on the front side facing away from the metal bellows, and the pressure piece 14 is in turn screwed into a thread located in the interior of a tubular attachment 19 forming part of the housing 1. The pressure piece 14 for its part is permanently connected, by press fitting for example, to an operating element 18 in order to set the required temperature.

The peg 15 protrudes through a plurality of centrally perforated bimetal discs 17 which are supported on the one hand on the front side of the connecting piece 13 facing away from the metal bellows 9 and on the other hand are supported on the pressure piece 14. Each bimetal disc 17 has a curved shape which causes its height to be reduced when heated.

In a modified embodiment depicted in FIG. 3 an adjustment element 23 is screwed centrally into the front side of the pressure piece 14, with the adjustment element in this case fitted of course with the guide bore 16. The bimetal discs 17 are supported on this adjustment element 23. In addition, the temperature adjustment made during manufacture can also be altered at a later point via an opening 24 in the operating element 18.

The number of the bimetal discs 17 selected and the arrangement selected depend on the travel of the metal bellows 9 to be compensated and the forces to be transmitted. It is known that the arrangement of the bimetal discs 17 can produce different effects. A stack of bimetal discs 17 with the same curvature alignment can therefore transmit higher forces but can compensate only as much travel as one bimetal disc 17. If the bimetal discs 17 are arranged in pairs with their curvatures opposed, the travel of the bimetal discs 17 is aggregated. However, only as much power can be transmitted in this way as can be transmitted by one bimetal disc 17.

In this execution example therefore four bimetal discs 17 are used which are arranged in pairs with their curvatures opposed and which compensate the effect of the ambient temperature on the temperature control valve 7.

The pressure piece 14 in this execution example is constructed in two parts and comprises a cup-shaped upper part 20 and a tubular lower part 21 which are permanently interconnected by being pressed together for example. On its side facing towards the upper part 20 the lower part 21 has a continuous turned recess 22 in which the connecting piece 13 can be supported during assembly. The upper part 20 provides a casing for the bimetal discs 17 (FIG. 2) located on the peg 15. In this way a component assembly is produced which is particularly suitable for simple retrofitting.

LIST OF REFERENCE NUMERALS

1 Housing
2 Gas inlet
3 Gas outlet
4 Ignition gas outlet
5 Operating element
6 Pressure regulator
7 Temperature control valve
8 Ram
9 Metal bellows
10 Capillary line
11 Temperature sensor
12 Ball
13 Connecting piece
14 Pressure piece
15 Peg
16 Bore guide
17 Bimetal disc
18 Operating element
19 Attachment
20 Upper part
21 Lower part
22 Turned recess
23 Adjustment element
24 Opening

The invention claimed is:

1. A temperature control valve (7) for a gas regulator fitting, the gas regulator having a housing (1) having at least one gas inlet (2) and at least one gas outlet (3), forpmed therein, the housing (1) configured for gas flow from the at least one gas inlet (2) to the at least one gas outlet (3), the temperature control valve (7) disposed on the housing and configured to control an amount of gas flow between the at least one gas inlet (2) and the at least one gas outlet (3), the temperature control valve comprising:

an operating element (18) for setting a required temperature;

a metal bellows supported on the operating element (18) and controlling the position of a movable ram (8);

at least one bimetal disc (17) disposed between the operating element (18) and the movable ram (8); such that the at least one bimetal disc (17) alters the position of the metal bellows (9) dependent on ambient temperature; and wherein the at least one bimetal disc (17) is arranged between the metal bellows (9) and the operating element (18).

2. A temperature control valve (7) for a gas regulator fitting according to claim 1, wherein a connecting piece (13) is supported on the metal bellows (9), and that the at least one bimetal disc (17) is on the one hand supported on a front side of the connecting piece (13) facing away from the metal bellows (9) and on the other hand is supported on the operating element (18).

3. A temperature control valve (7) for a gas regulator fitting according to claim 2, wherein, the at least one bimetal disc (17) is centrally perforated, and wherein the connecting piece (13) has an axial peg (15) for receiving the at least one centrally perforated bimetal disc (17) and that said axial peg (15) is guided in a guide bore (16) of a pressure piece (14) which is permanently connected to the operating element (18) and on which the at least one bimetal disc (17) are supported.

4. A temperature control valve (7) for a gas regulator fitting according to claim 3, wherein an adjustment element (23) whose position can be adjusted and which acts in an axial direction on the at least one bimetal disc (17) is connected to the pressure piece (14).

* * * * *

UNITED STATES PATENT AND TRADEMARK OFFICE

CERTIFICATE OF CORRECTION

PATENT NO. : 9,151,497 B2
APPLICATION NO. : 14/102094
DATED : October 6, 2015
INVENTOR(S) : Barbara Happe et al.

It is certified that error appears in the above-identified patent and that said Letters Patent is hereby corrected as shown below:

In the claims

Column 4, line 34, after “outlet (3),” delete “forpmed” and insert therein -- formed --.

Signed and Sealed this
Fifth Day of April, 2016

Michelle K. Lee

Michelle K. Lee
*Director of the United States Patent and Trademark Office*